US006126477A

United States Patent [19]

Smith et al.

[11] Patent Number: 6,126,477

[45] Date of Patent: Oct. 3, 2000

[54] METHOD FOR ATTACHING HELICAL CONDUIT TO RECTANGULAR BACKSHELL

[76] Inventors: Stan Smith; Edward P. Goett, both of P.O. Box 994, Healdsburg, Calif. 95448

[21] Appl. No.: 09/277,325

[22] Filed: Mar. 26, 1999

Related U.S. Application Data

[60] Provisional application No. 60/079,503, Mar. 26, 1998.

[51] Int. Cl.[7] ..... H01R 13/56

[52] U.S. Cl. ..... 439/447; 439/610

[58] Field of Search ..... 439/447, 448, 439/98, 610, 445, 446

[56] References Cited

U.S. PATENT DOCUMENTS 5,018,987 5/1991 Kirma ..... 439/447

5,823,817 10/1998 Pyle ..... 439/447

*Primary Examiner*—Renee Luebke
*Assistant Examiner*—Antoine Ngandjui
*Attorney, Agent, or Firm*—Johnson & Stainbrook, LLP; Craig M. Stainbrook; Larry D. Johnson

[57] ABSTRACT

A cable connector adapter comprising a segment of tubular elastically deformable flexible conduit, having an outside surface of helical convolutions, connected to a cable connector boot having an integrally formed oval female threaded nut into which the conduit is screwed in a deformed, oval configuration. The conduit is deformed into an oval shape to fit and screw into the oval threaded female nut, said deformation flattening the conduit and adapting it to the generally rectangular shape of the boot and connector, thereby providing the transition in the shape of the bundle of conductors of the cable from round substantially rectangular.

7 Claims, 2 Drawing Sheets

METHOD FOR ATTACHING HELICAL CONDUIT TO RECTANGULAR BACKSHELL

This application claims the priority of U.S. Provisional Application Ser. No. 60/079,503, filed Mar. 26, 1998.

BACKGROUND OF THE INVENTION

1. Field of the Invention

The present invention relates generally to cable connectors, and more particularly to cable connector adapters for terminating to the conductors of a shielded electric cable while transitioning to a narrower rectangular connector from a wider round cable.

2. Description of the Prior Art

A myriad of electrical devices are connected to power and other electrical devices by cables terminating to detachable connectors, typical of which are U.S. Pat. Nos. 4,577,919, 4,830,629, 5,041,011, 5,195,909, 5197,900, and 5,244,415. In addition to facilitating convenient and rapid attachment and detachment of cables, the connectors also function as grounds, shields, strain reducers, and space savers. However, despite the economical geometry of the generally rectangular connectors, in many instances the often unseen environment behind a device is a space consuming, dense and congested tangle of wires and cables. This is particularly evident in high performance aircraft, where an immense array of communication, navigation, flight control instruments, and computers are fed and interlinked by a staggeringly complex network of cables and wires.

In such environments, where both space and weight are at a premium, cable connectors are typically organized in tight, space-economizing rows and columns. However, the capacity to organize and save space with the connectors frequently surpasses the capacity to do the same with the cables, often simply because the round cables are wider than the generally rectangular connectors. With wider cables, the conventional transitional hardware requires that the rectangular connectors be spaced further apart to provide clearance for the cable. Connectors typically do not provide a means for transitioning down from wide cable to narrow connector while also segregating and directing cables away from the device interface so as to prevent physical impingement and minimize tangle and congestion.

Accordingly, what is needed is a device to transition narrow rectangular connectors from wider round cables in such a way as to direct, organize, separate, mechanically protect, and provide strain relief for the cables. To accomplish this the transition should be able to terminate multiple wire shields and should provide a virtually unlimited number of angle entry options. Further, such a device should be lightweight, economical to manufacture, easy to repair and replace, and easy to manipulate in the working environment.

Three kinds of transitions are generally employed to transition from round cables to rectangular connectors: molded transitions, mechanical transitions, and heat shrinkable, premolded boots. Molded transitions, by far the most common due to their simple manufacture, nonetheless have several drawbacks. Because they are permanent and fixed by their very nature, they do not allow repair or reworking of the connector. The angle of cable entry is predetermined and cannot be altered. Furthermore, there is only a small amount of space allocated to terminating wire shields, thus effectively limiting the number of wire shields that can practically be terminated to the connector. This is why rectangular connectors are eminently suited for flat ribbon cable but only smaller diameter round cables.

Mechanical transitions are formed by connecting several plastic and metal parts. They have some advantages over molded transitions: they can be repaired, and the entry angle for the cable can sometimes be altered, but then only by disassembling and reassembling the device, and the angle entry options remain quite limited. Additionally, they tend to relocate cable stress rather than providing strain relief, as do molded transitions.

Heat shrinkable, premolded boots are rarely employed due to their expense. They have all of the disadvantages of molded transitions, though they can be repaired by cutting off the boot and installing a new one.

SUMMARY OF THE INVENTION

In its simplest embodiment, the cable connector adapter of the present invention comprises a length of tubular elastically deformable flexible conduit, having an outside surface of helical convolutions, connected to a cable connector boot having an integrally formed oval female threaded nut into which the conduit is screwed in a deformed, oval configuration (effectively creating a new thread). The essential characteristic of the conduit, and from which the many advantages of this invention derive, is the ease with which it may be deformed from a tubular shape to an oval shape to conform to the oval screw hole. The connector boot has an open connector receiving end, a conduit receiving end, opposing outer sidewalls, and opposing outer end walls. The perimeter of the open connector receiving end of the boot has flanges with apertures for connecting the boot to a complementary connector with screws.

The two primary components are assembled in a simple fashion: the readily deformable conduit is deformed (e.g., by pinching it) in two dimensions into an oval shape to fit and screw into the oval threaded female nut. This deformation flattens the conduit in two dimensions and adapts it to the generally rectangular shape of the boot and connector, thereby providing the transition in the shape of the bundle of conductors of the cable from round to substantially rectangular.

In addition, multiple cable conductors can be terminated throughout the length of the conduit in a staggered sequential fashion, because cable overbraid can be exposed throughout the length of the conduit. This increases the size of cable the connector can accommodate, reduces the amount of space required in the immediate vicinity of connector interfaces, and provides increased cable strain relief.

Without modification or disassembly, the adapter allows multiple angle entry options. And because it is so lightweight, it is well-adapted for use in aircraft applications.

DETAILED DESCRIPTION OF A PREFERRED EMBODIMENT

Figure 1:
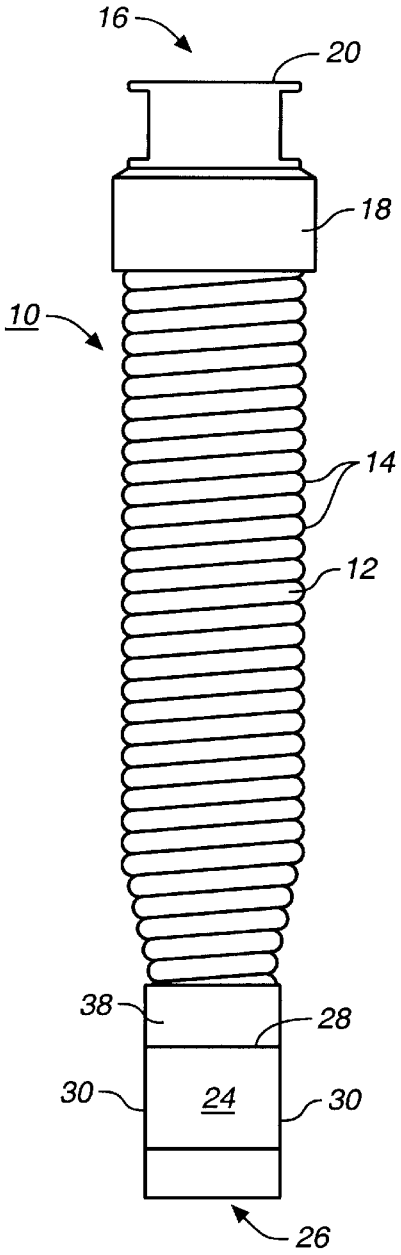
FIG. 1 is a side elevation view of the cable connector/adapter of the present invention.
Figure 2:
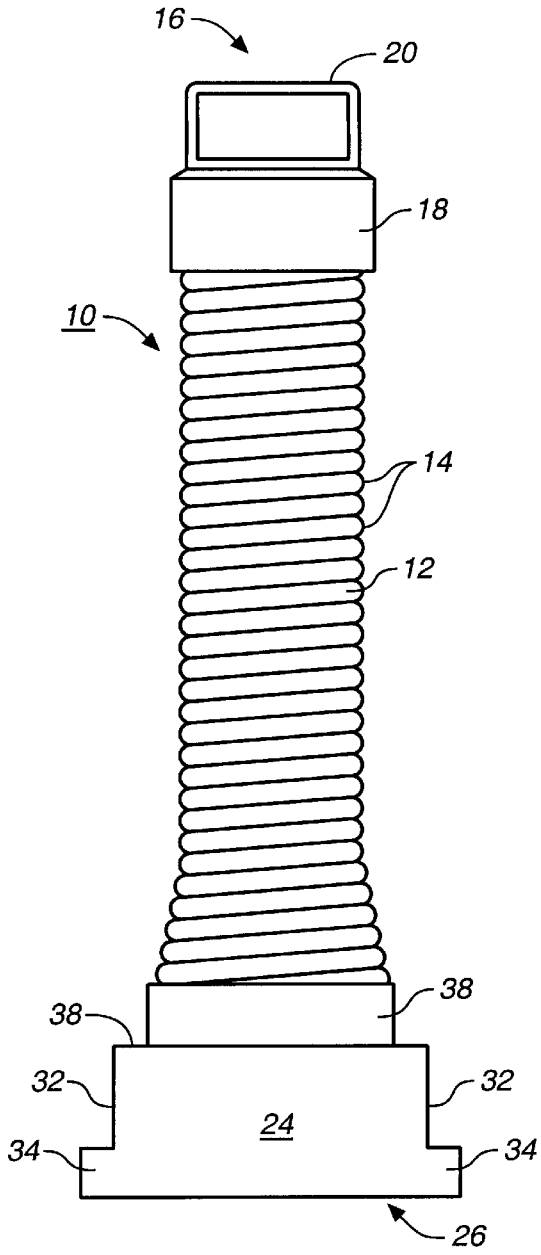
FIG. 2 is a top plan view of the present invention.
Figure 5:
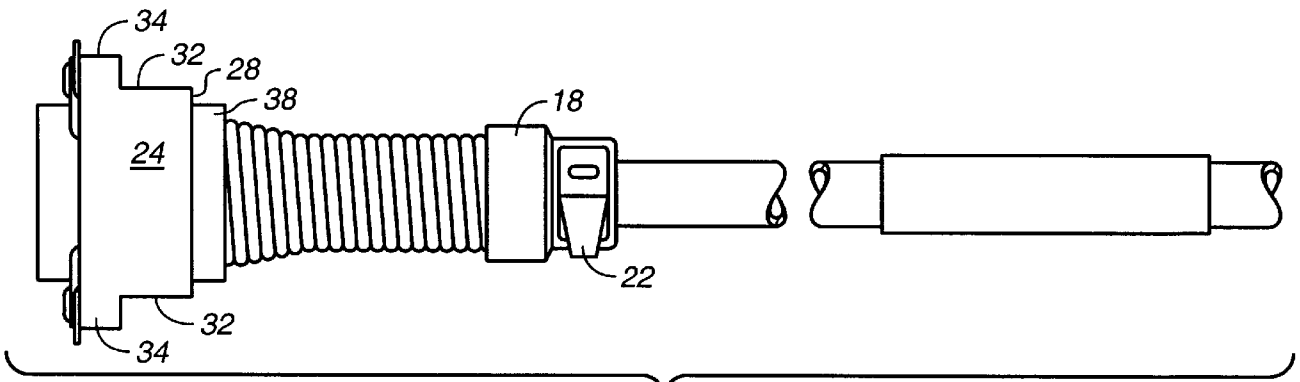
FIG. 5 is a side elevation view of the invention as in FIG. 4 in its configuration assembled with a connector and cable.

FIGS. 1 and 2, are a side elevation view and top plan view, respectively, of the cable connector adapter of the present invention. The adapter, generally denominated 10, comprises a length of tubular elastically deformable flexible conduit 12 fabricated with an outside surface of helical convolutions 14. This conduit can be fabricated from a number of materials, including extruded thermoplastic elastomers, but its essential characteristic is the ease with which it may be deformed. Said conduit has an open cable receiving end 16, at which end is affixed an integrally formed tie wrap housing 18 having a flange 20 at its distal end for secure application of a tie wrap 22 (FIG. 5).

FIGS. 1 and 2 further show that at the opposing end, the conduit 12 terminates into a boot 24, having an open connector receiving end 26, a conduit receiving end 28, opposed outer sidewalls 30, and opposed outer end walls 32. The perimeter of the open connector receiving end 26 of the boot 24 has flanges 34 at the proximal end of each of said end walls 32, each of said flanges having holes 36 (FIG. 3) therethrough for receiving jack screws to connect it to a complementary connector. The boot may be fabricated from a number of lightweight block polymers, but the preferred material is a thermoplastic polymer.

Figure 3:
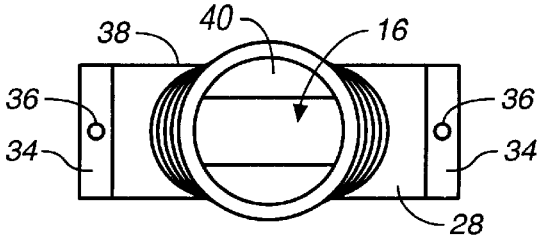
FIG. 3 is a end elevation view from the cable receiving end illustrating the view down the opening of the convoluted conduit toward the proximal end.

FIGS. 2 and 3 show that integrally formed at the conduit receiving end 28 of said boot 24 is an oval female nut 38 having an oval threaded screw hole 38 with threads 40 (FIG. 4) complementary to the helical surface convolutions 14 of said conduit 12.

All of the figures show the invention in its assembled configuration. In assembly, the readily deformable conduit 12 is deformed in two dimensions into an oval shape to fit and screw into said oval female nut 38. FIGS. 1 and 3 show that such deformation effectively flattens said conduit in two dimensions and adapts it to the generally rectangular shape of the boot 24 and connector. This mechanical deformation effects the geometrical component of the transition from a round cable to a rectangular connector.

Figure 4:
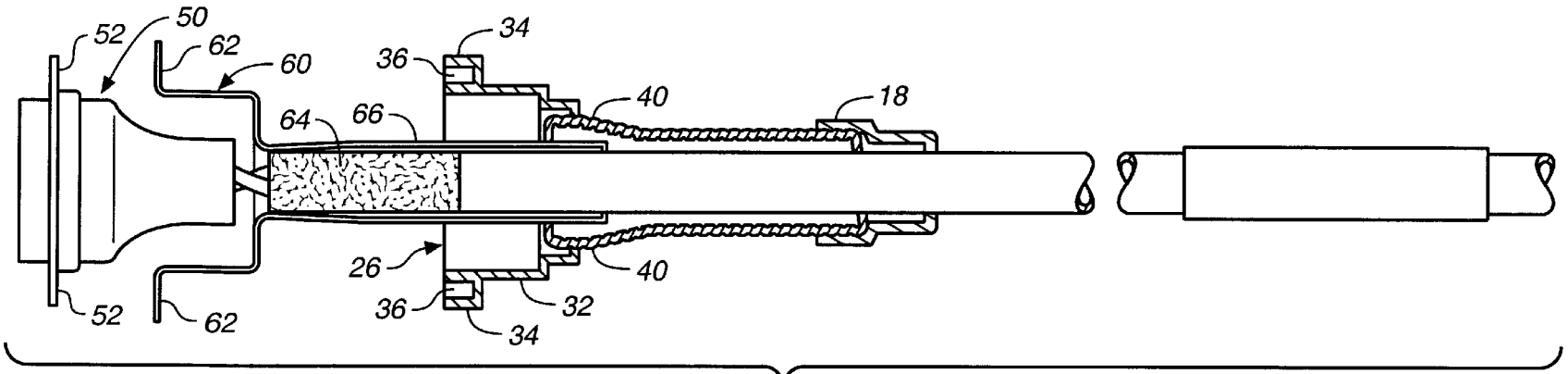
FIG. 4 is a cross-sectional side elevation view of the present invention and a connector and cable in partial disassembly.

However, as shown in FIG. 4, multiple cable conductors can be terminated to an overbraid 64 throughout the length of the conduit 12. Because a cable overbraid can be exposed throughout the length of the conduit, much larger cables with numerous wires may be terminated in staggered and sequential fashion rather than in the small space of the connector housing itself. Spatial economy is greatly served by this feature alone.

FIG. 4 is a cross-sectional side elevation view of the present invention along with existing connector and cable in partial disassembly. FIG. 5 is a side elevation view of the invention as in FIG. 4 in fully assembled configuration. The connector 50 is fitted into a shielding clip 60 and overbraid sock 66, each of which is slid into the connector receiving end 26 of the boot 24. The metal flanges of the connector 52 and metal flanges of the shielding clip 62 are aligned with the holes of the flanges 34 at the boot sidewalls 32, so that a jack screw can be passed through each so as to retain them to one another at the proximal end of the adapter. In this configuration, exposed cable overbraid 64 runs the length of the conduit for termination of cable conductors. A tie wrap 22 wrapped and fastened at the tie wrap housing 20 tightly secures the distal end of the adapter to the cable.

In use, the adapter allows for the minimum spacing of rectangular connectors regardless of the size of the round electric cables. It allows for multiple terminations within the flexible conduit segment of the adapter, thus providing increased strain relief. Most importantly, without any modification or disassembly, it allows 360 degrees of angle entry options in one plane, along with 220 degrees of angle entry options in a perpendicular plane, all due to the flexibility of the conduit, which may still be fixed in a flexed or angled position. Thus, large round cables can be transitioned down to relatively narrow rectangular connectors, while the adapter further serves to direct, protect, organize, and segregate the cables, all in a very small space. Furthermore, the adapter is extremely lightweight, making it ideally well-suited for aviation applications. Finally, it is inexpensive and easy to manufacture, making it attractive compared to less efficient, but more expensive alternatives, or no transition hardware at all.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A cable connector adapter for terminating to conductors of a shielded cable, comprising:

a connector boot having a generally rectangular profile from every viewing angle for housing an existing cable connector, said connector boot having an open connector receiving end and a conduit receiving end;

a length of tubular elastically deformable flexible conduit having helical surface convolutions, an open cable receiving end, and an opposing end for connection to said connector boot at said conduit receiving end of said connector boot;

fastening means at said open cable receiving end of said conduit for securely fastening said conduit to an existing round electric cable;

connection means for securely coupling said connector boot to an existing cable connector and shield clip; and an oval female nut integrally formed at said conduit receiving end of said connector boot, having an oval threaded screw hole with threads complementary to said helical surface convolutions of said conduit, such that said conduit can be screwed into said oval threaded screw hole and securely fastened to said boot, said conduit deforming to engage the threads of said oval female nut.

2. The cable connector adapter of claim 1, wherein said fastening means comprises;

an integrally formed tie wrap housing having a flange; and a tie wrap securely wrapped around said tie wrap housing immediately proximal to said flange.

3. The cable connector adapter of claim 1, wherein said connection means comprises:

at least one integrally formed flange in said connector boot having a hole passing therethrough for aligning with at least one screw hole of an existing cable connector and shielding clip; and at least one jack screw for retaining said integrally formed flange(s) to an existing cable connector and shielding clip.

4. The cable connector adapter of claim 1 wherein said conduit is fabricated of an extruded thermoplastic elastomer.

5. The cable connector adapter of claim 1 wherein said connector boot is fabricated from a thermoplastic polymer.

6. A cable connector adapter for terminating to conductors of a shielded cable, comprising:

a connector boot having a generally rectangular profile from every viewing angle, and having an open connector receiving end, a conduit receiving end, a first outer sidewall, a second outer sidewall opposing said first outer sidewall of said boot, a first outer end wall, and a second outer end wall opposing said first outer end wall;

connection means for retaining said boot to an existing cable connector;

a length of tubular elastically deformable flexible conduit having helical surface convolutions, an open cable receiving end, and a boot connecting end;

an integrally formed tie wrap housing affixed to said conduit at said open cable receiving end, said tie wrap housing having a flange for securing a tie wrap, said flange located distal relative to said connector boot when said conduit is connected to said connector boot; and an integrally formed oval female nut at said conduit receiving end of said connector boot, said oval female nut having an oval threaded screw hole with threads complementary to said helical surface convolutions of said conduit such that said conduit can be screwed into said oval threaded screw hole and securely fastened to said boot, said conduit deforming to engage the threads of said oval female nut.

7. The cable connector adapter of claim 6, wherein said connection means comprises:

a first integrally formed flange at said open connector receiving end of said first end wall and having a hole passing therethrough for aligning with screw holes of and existing cable connector and shielding clip;

a second integrally formed flange at said open connector receiving end of said second end wall and having a hole passing therethrough for aligning with screw holes of an existing cable connector and shielding clip;

a first jack screw for retaining said first integrally formed flange to an existing cable connector and shielding clip; and a second jack screw for retaining said first integrally formed flange to an existing cable connector and shielding clip.

* * * * *